US006241166B1

(12) United States Patent
Overington et al.

(10) Patent No.: US 6,241,166 B1
(45) Date of Patent: Jun. 5, 2001

(54) SHOWER HEAD ROSE

(75) Inventors: John Overington; Leonard Paul Gauntlet, both of Birmingham (GB)

(73) Assignee: Purdie Elcock Limited (GB)

( * ) Notice: Subject to any disclaimer, the term of this patent is extended or adjusted under 35 U.S.C. 154(b) by 0 days.

(21) Appl. No.: 09/525,433

(22) Filed: Mar. 14, 2000

(30) Foreign Application Priority Data

Mar. 27, 1999 (GB) ..... 9907054

(51) Int. Cl.[7] ..... B05B 1/14

(52) U.S. Cl. ..... 239/553.3; 239/462; 239/504; 239/523; 239/524; 239/548; 239/554; 239/559; 239/567; 239/590.3; 239/596; 239/DIG. 23

(58) Field of Search ..... 239/461, 462, 239/499, 504, 518, 523, 524, 548, 552, 553.3, 553.5, 554, 555, 558, 559, 567, 589, 590, 590.3, 590.5, 596, DIG. 23

(56) References Cited

U.S. PATENT DOCUMENTS

| | | | | |
|---|---|---|---|---|
| 977,389 | * | 11/1910 | Heldt | 239/558 |
| 1,891,720 | * | 12/1932 | McCurdy et al. | 239/559 |
| 1,930,227 | * | 10/1933 | Donahue | 239/558 X |
| 2,086,017 | * | 7/1937 | Donahue | 239/596 X |
| 2,690,930 | * | 10/1954 | Corson | 239/548 X |
| 2,779,625 | * | 1/1957 | Filliung | 239/558 X |
| 2,874,001 | * | 2/1959 | Webb | 239/553.3 X |
| 3,081,404 | * | 3/1963 | Hartmann | 239/596 X |
| 3,831,860 | * | 8/1974 | Gullaksen et al. | 239/553.3 X |
| 6,113,002 | * | 9/2000 | Finkbeiner | 239/548 X |

FOREIGN PATENT DOCUMENTS 0 284 763 5/1988 (EP) .

* cited by examiner

*Primary Examiner*—David A. Scherbel
*Assistant Examiner*—Robin O. Evans
(74) *Attorney, Agent, or Firm*—Michael Best & Friedrich LLP

(57) ABSTRACT

A shower head has a first chamber defined in part by an outer wall or body and having an entrance bush to receive a supply of water which is deflected into the first chamber by a baffle on spaced legs depending from the bush. The shower head has a second chamber comprising an upper conical wall formed with a ring of openings therein through which water can pass from the first chamber into the second chamber. The second chamber has a lower wall or spray plate with fine water outlet apertures and also has an external peripheral rim at the level of the spray plate. The second chamber is a one-piece unit in which the upper conical wall is secured to the baffle by a screw threaded bolt acting to pull the second chamber into the first chamber and clamp the peripheral rim against a sealing ring pressing on an internal annular shoulder of the outer wall or body.

19 Claims, 2 Drawing Sheets

SHOWER HEAD ROSE

This invention relates to a shower head rose.

The shower head roses concerned may be of relatively large diameter, for example substantially 101.6 mm (4 inches), 127 mm (5 inches), 152.4 mm (6 inches), 203.2 mm (8 inches), 254 mm (10 inches), 304.8 mm (12 inches) in diameter.

Shower head roses are known having an outer body of brass of an inverted-cup shape into an open mouth of which is fitted a circular spray plate of brass permanently clamped to the outer body by annular formations formed in the body by metal spinning; the outer body extending beyond the spray plate as an annular skirt which encircles the water spray emergent from the spray plate.

A number of drawbacks can arise with such known shower head roses. Deflections of the supplied water within the outer body can cause the water spray emergent from the spray plate to be deformed such that individual streams may cross one another instead of being generally parallel; the crossing over being an effect known as "chiselling". At relatively high input water pressure, the spray plate can be forced out of the body. Normally the shower head roses are finished by chromium plating the outer surfaces of the outer body and the spray plate. As part of the procedure a coating of nickel is laid down on the brass. This coating is yellow. There can be some difficulty in getting the chromium-plating solution into the internal annular corner between the outer body and the spray plate. Thus the corner is not properly chromium-plated leaving yellow nickel uncovered to look like rust forming in the corner, which is not a desirable appearance to create. Also the plating solution can get inside the body and get trapped behind the spray plate making it difficult to fully drain off.

An object of the invention is to provide a construction of shower head rose which enables a shower head rose to be made which avoids one or more of the aforesaid drawbacks.

According to the invention there is provided a shower head rose comprising a first chamber comprising an outer wall or body and having an entrance to receive a supply of water, a second chamber defined by a second chamber wall comprising a first wall part and a second wall part, said first wall part being formed with water inlets opening into the first and second chambers whereby water from the first chamber can enter the second chamber, said second wall part being formed with water outlets through which water can emerge from the second chamber as relatively fine streams or spray, and said second chamber being disposed in the outer wall or body and clamped thereto by connection means urging the second chamber in a direction towards said entrance.

Preferably the first chamber is provided with deflection or baffle means for the supply of water along a first direction through the entrance to impinge on the deflection or baffle means and be deflected into one or more paths each along a direction transversely to said first direction and towards a water deflecting inner surface of the first chamber in which said inner surface is spaced from aforesaid water inlets.

Preferably, externally of the second chamber an outer surface of at least a portion of said first wall part is of a form which is generally convex or bulging outwardly with respect to the second chamber. Preferably, the convex or outwardly bulging form of said outer surface of said portion of the first wall part is of substantially conical shape. In another embodiment, the convex or outwardly bulging form of said outer surface of said portion of the first wall part may be of substantially segmental spherical shape. The said convex or outwardly bulging form of said portion of said first wall part may face in a general direction towards said entrance. One or more of said water inlets may each have a first side and an opposite second side, and the first side may be nearer to a top or crest of said convex or outwardly bulging form of said portion of said first wall part than the second side of the water inlet is to a base of said convex or outwardly bulging form of said portion.

Preferably, a seal is provided between the outer wall or body and the second chamber wall, and said seal surrounds the second chamber wall and makes water-tight contact therewith and with the outer wall or body. The seal may comprise a rubber. For example the seal may be a rubber O-ring. Preferably the connection means may be provided between the outer wall or body and the second chamber wall, said connection means being adapted for action causing clamping of the seal between the outer wall or body and said second chamber wall. If desired, the connection means may comprise a screw-threaded arrangement to oppose separation of the second chamber for said outer body or wall. The screw-threaded arrangement may be operable to vary clamping force exerted on the seal.

The second chamber may have an internal cross-sectional area in a plane transverse to emergent directions of aforesaid water spray from the second chamber, and said cross-sectional area may be a plurality of times greater than a total cross-sectional area of the said water inlets. The said internal cross-sectional area of the second chamber may be at least twenty times greater than the said total cross-sectional area of the water inlets, for example it may be at least forty times greater.

Aforesaid water inlets may be disposed in an array about an axis of revolution of the second chamber. The array may be a circle substantially centred on the axis, and a centre of each of at least three of said water inlets may lie substantially on said circle.

If desired, said second wall part is a spray plate having a turned over peripheral rim clamping onto a peripheral rim of the first wall part to form an external peripheral lip on the second chamber wall. An aforesaid seal may be disposed between the lip and an abutment on the outer wall or body.

Said outer wall or body may extend beyond the second wall part to provide a skirt which surrounds the emergent spray.

One or more water drain holes may be provided through the first wall part adjacent to a or the base of said convex or outwardly bulging form of said outer surface of said portion.

The invention will now be further described, by way of example, with reference to the accompanying drawings in which.

Figure 1:
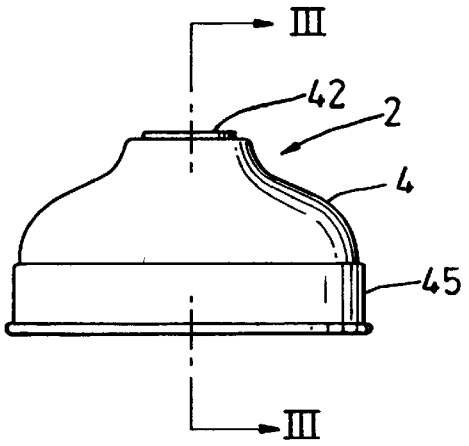
FIG. 1 is an elevation of a shower head rose formed according to the invention.
Figure 2:
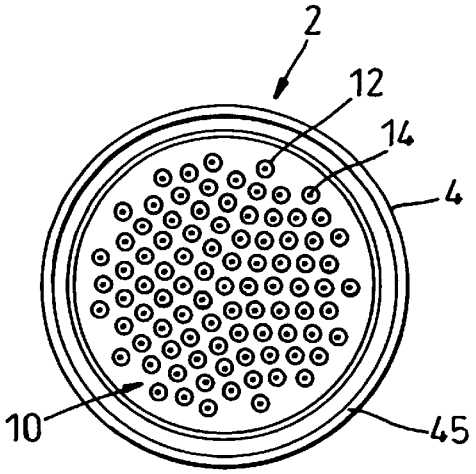
FIG. 2 is an inverse plan view of the shower head rose in FIG. 1.
Figure 3:
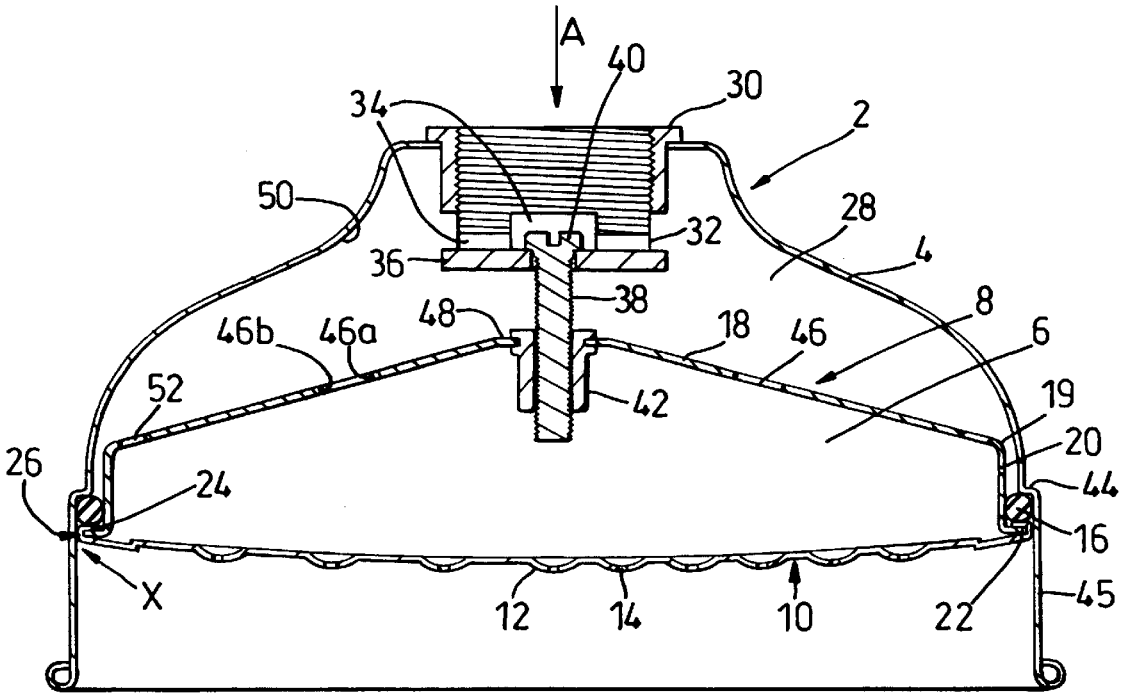
FIG. 3 is a section on line III—III in FIG. 1 but to a larger scale than that used in FIG. 1.
Figure 4:
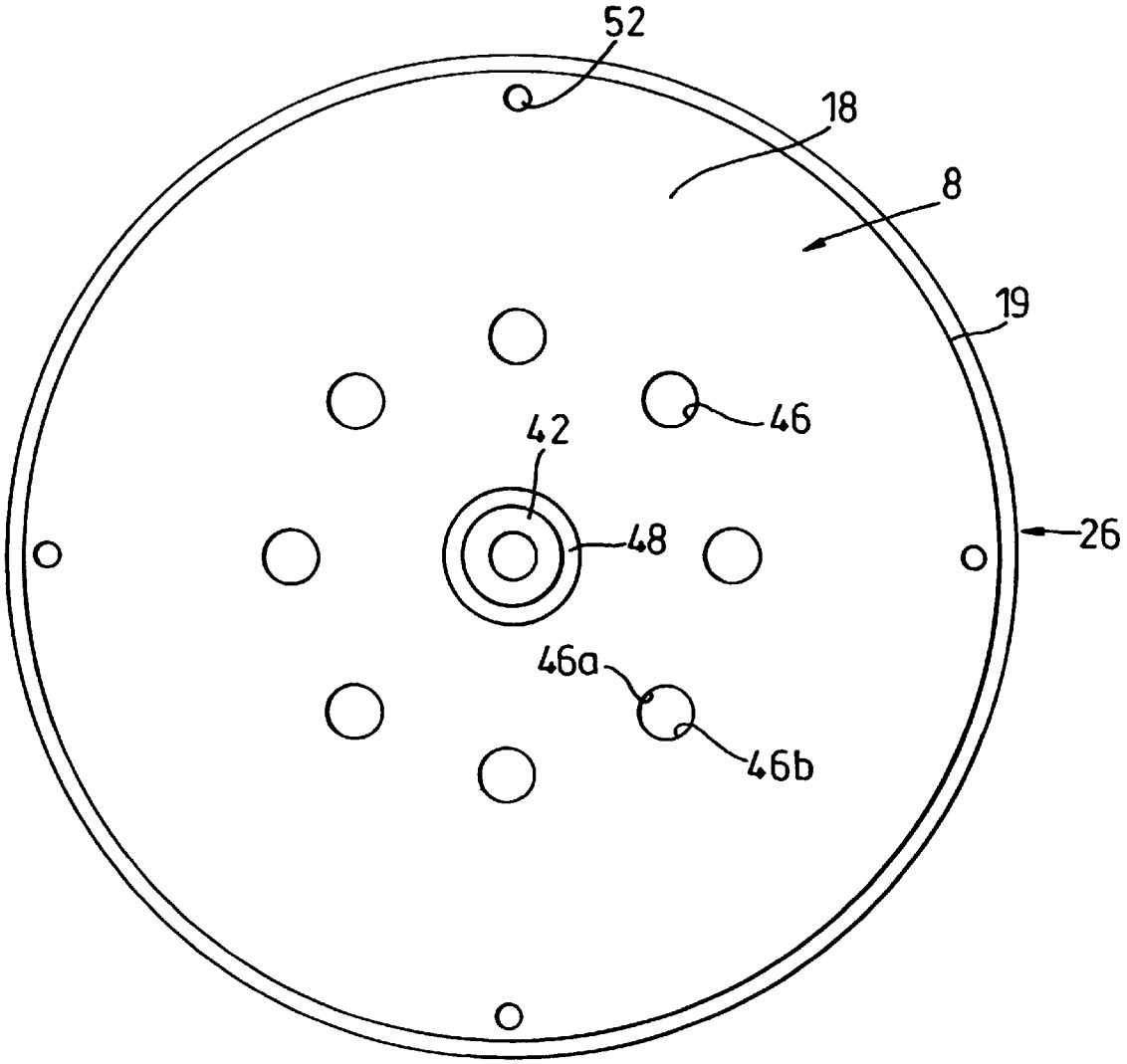
FIG. 4 is a plan view, to the same scale as in FIG. 3, of the second chamber.

In the drawings a shower head rose 2 has a hollow outer body 4 of an inverted-cup or dome shape of circular cross-section containing a chamber 6 of circular cross-section defined by an upper wall 8 and a lower wall or spray plate 10 formed with external pimples 12 surrounding fine water outlet apertures 14. With the exception of a rubber sealing O-ring 16 all the other components illustrated can be made of metal, preferably a non-rusting metal, for example brass, though the upper wall 8 may be of stainless steel.

With respect to the interior of chamber 6 the upper wall 8 has a wall portion 18 which is convex or outwardly bulging. The wall portion 18 may be a segment of a sphere in shape but in the drawings is shown as being a cone or frusto-conical in shape with a base 19 of the cone radiusing into a cylindrical wall 20 having a radially extending peripheral rim part 22 firmly clamped to the spray plate 10 by a turned over peripheral rim part 24 of the spray plate, thereby forming a generally radially extending, annular external peripheral lip 26 on the chamber 6 which is an integral or one-piece unit. The height of the chamber 6 from the spray plate 10 is shown relatively short; it may be increased, for example, by increasing the cone or bulge height of the wall portion 18. Between the upper wall 8 and the outer body 4 is another chamber 28 within the outer body.

At an upper end of the outer body 4 is an entrance for a water supply in the direction of arrow A, said entrance comprising a cylindrical bush 30 internally screw threaded for connection to a water supply pipe. At its lower end the bush 30 has depending legs 32 which are spaced by radial gaps 34 and support a baffle or deflection plate 36 extending transversely to direction A. A bolt 38 has a head 40 engaging the deflection plate. The screw threaded shank of the bolt 38 threadably engages a bush 42 firmly mounted on a tip or crest 48 of the convex or bulging wall portion 18. An internal annular shoulder 44 formed on the outer body 4 demarcates an upper end of a cylindrical skirt 45 at a lower end of the outer body. When the sealing ring 16 is disposed around the chamber 6 and between the lip 26 and the shoulder 44 and the bolt 38 is passed through the plate 36 and threaded into the bush 42, tightening of the bolt progressively draws up the chamber 6 increasingly clamping the sealing ring in a water-tight manner between the lip and shoulder.

A plurality of openings 46 is formed in the outwardly convex or bulging wall portion 18 which has its tip or crest 48 facing towards the water supply entrance 30. The chamber 6 is a body of revolution about an axis and the centres of the openings 46 each lie on an imaginary common circle substantially centred on said axis. Each opening 46 has opposite sides 46*a* and 46*b* with upper side 46*a* being nearer to the tip or crest 48 than the lower side 46*b* is to the base 19 of the convex or bulging wall portion 18. For example the centre of each opening 46 may lie substantially one third of the distance along the wall portion 18 from its axis to its base 19. The internal cross-sectional area of the chamber 6 transverse to its axis is a plurality of times greater than the total cross-sectional area of the openings 46.

A stream of water introduced into the entrance 30 has its direction of flow abruptly changed by the deflection plate 36 into a plurality of streams (transversely to the direction A) through the gaps 34 so that the deflected flows are again deflected downwards by inner surface 50 of the outer body 4. So the water passes from the chamber 28 into the chamber 6 through the openings 46. But the flow in the chamber 6 is not as turbulent or random as in the chamber 28 but more constrained (which may at least in part be due to the upper wall 8 acting as a baffle) so there is a tendency for the water streams emerging from the apertures 14 to be parallelised.

The connection using the bolt 38 can be strong and thus the chamber 6 with its spray plate 10 can be held in position against relatively high water pressure, for example up to substantially six bars. Also the outwardly bulging or conical character of the wall portion 18 can mitigate the effect of water pressure in the chamber 28 on the wall portion 18, which mitigation may be increased by increasing the slope of that wall portion.

Small drain holes 52 may be provided through the wall portion 18 adjacent to the base 19 thereof to drain residual water from the chamber 28 when the supply is turned off. This drainage can prevent retention of stagnant water in the chamber 28, and thus be beneficial for hygiene and health.

Since the chamber 6 can be formed separately and later installed in the outer body 4 the latter may be easily and readily chromium plated to the extent desired. Also when constructing the chamber 6, the spray plate 10 may be easily and readily chromium plated to the extent desired and then bent at 24 to grip of rim 22. Thus no undesirable yellow nickel need be exposed to view at the internal annular corner X between the outer body and the spray plate.

We claim:

1. A shower head rose comprising:

a first chamber comprising
an outer wall and having
an entrance to receive a supply of water, a second chamber defined by a second chamber wall comprising
a first wall part and
a second wall part,
said first wall part being formed with water inlets opening into the first and second chambers whereby water from the first chamber can enter the second chamber,
said second wall part being formed with water outlets through which water can emerge from the second chamber as relatively fine spray,
said second chamber being disposed in the outer wall and clamped thereto by connection means urging the second chamber in a direction towards said entrance, with respect to a general direction of water flow through the rose, said spray is to emerge from the second wall part at a downstream side of said second wall part, said downstream side being at an opposite side of said second wall part to an upstream side of the second wall part, said connection means comprising a screw-threaded arrangement operable for pulling the second chamber towards said entrance, and said screw-threaded arrangement being within the outer wall and being wholly disposed to said upstream side of the second wall part.

2. A shower head rose according to claim 1, wherein the second chamber is an integral one-piece unit.

3. A shower head rose according to claim 1, wherein a baffle is mounted for water entering the first chamber through said entrance to impinge on the baffle, and the screw-threaded arrangement comprises a screw-threaded bolt engaging both the baffle and said first wall part of said second chamber, and the bolt is operable for pulling the second chamber towards the entrance.

4. A shower headrose according to claim 1, wherein the first chamber is provided with deflection means for the supply of water along a first direction through the entrance to impinge on the deflection means and be deflected into one or more paths each along a direction transversely to said first direction and towards a water deflecting inner surface of the first chamber in which said inner surface is spaced from aforesaid water inlets.

5. A shower head rose according to claim 1, wherein externally of the second chamber an outer surface of at least a portion of said first wall part is of a form which is generally bulging outwardly with respect to the second chamber.

6. A shower head rose according to claim 5, wherein said outwardly bulging form of said outer surface of said portion of the first wall part is of substantially conical shape.

7. A shower head rose according to claim 5, wherein said outwardly bulging form of said outer surface of said portion of the first wall part is of substantially segmental spherical shape.

8. A shower head rose according to claim 5, wherein the said outwardly bulging form of said portion of said first wall part faces in a general direction towards said entrance.

9. A shower head rose according to claim 5, wherein there is a number of said inlets each having a first side and an opposite second side, and the first side is nearer to a top of said outwardly bulging form of said portion of said first wall part than the second side of the water inlet is to a base of said outwardly bulging form of said portion.

10. A shower head rose according to claim 1, wherein a seal is provided between said outer wall and said second chamber wall, and said seal surrounds said second chamber wall and makes water-tight contact therewith and with said outer wall.

11. A shower head rose according to claim 10, wherein said seal is clamped between a shoulder on the outer wall and said second chamber wall.

12. A shower head rose according to claim 1, wherein said connection means is provided between the outer wall and comprises a screw-threaded arrangement for opposing separation of the second chamber wall.

13. A shower head rose according to claim 1, wherein said second chamber has an internal cross-sectional area in a plane transverse to emergent directions of aforesaid water spray from the second chamber, and said cross-sectional area is a plurality of times greater than a total cross-sectional area of the said water inlets.

14. A shower head rose according to claim 13, wherein the said internal cross-sectional area of the second chamber is at least twenty times greater than the said total cross-sectional area of said water inlets.

15. A shower head according to claim 14, wherein the said internal cross-section area of the second chamber is at least forty times greater than the said total cross-sectional area of said water inlets.

16. A shower head rose according to claim 1, wherein the said water inlets are disposed in an array about an axis of revolution of the second chamber.

17. A shower head rose according to claim 1, wherein said second wall part is a spray plate having a turned over peripheral rim clamping onto a peripheral rim of the first wall part and forming an external peripheral lip on the second chamber wall.

18. A shower head rose according to claim 17, wherein a seal is disposed between the lip and an abutment on said outer wall.

19. A shower head rose according to claim 1, wherein said outer wall extends beyond the second wall part thereby providing a skirt for surrounding the emergent spray.

* * * * *